US008415551B1

(12) United States Patent
Dixon

(10) Patent No.: US 8,415,551 B1
(45) Date of Patent: Apr. 9, 2013

(54) COMPOSITE POLE PIECE MUSICAL INSTRUMENT PICKUP

(76) Inventor: George J. Dixon, Socorro, NM (US)

( * ) Notice: Subject to any disclaimer, the term of this patent is extended or adjusted under 35 U.S.C. 154(b) by 65 days.

(21) Appl. No.: 12/940,478

(22) Filed: Nov. 5, 2010

Related U.S. Application Data

(60) Provisional application No. 61/258,454, filed on Nov. 5, 2009, provisional application No. 61/258,912, filed on Nov. 6, 2009.

(51) Int. Cl.
*G10H 3/18* (2006.01)

(52) U.S. Cl. ..... 84/726; 84/725; 84/723

(58) Field of Classification Search ..... 84/723, 84/725–729
See application file for complete search history.

(56) References Cited

U.S. PATENT DOCUMENTS

| | | | | | |
|---|---|---|---|---|---|
| 2,573,254 | A | | 10/1951 | Fender | |
| 2,612,072 | A | | 9/1952 | De Armond | |
| 2,612,541 | A | * | 9/1952 | De Armond | 335/229 |
| 2,817,261 | A | | 12/1957 | Fender | |
| 2,892,371 | A | | 6/1959 | Butts | |
| 2,896,491 | A | | 7/1959 | Lover | |
| 2,909,092 | A | | 10/1959 | De. Amond | |
| 2,911,871 | A | * | 11/1959 | Schultz | 84/725 |
| 2,933,967 | A | * | 4/1960 | Riscol | 84/726 |
| 3,236,930 | A | | 2/1966 | Fender | |
| 3,249,677 | A | * | 5/1966 | Burns et al. | 84/726 |
| 3,541,219 | A | * | 11/1970 | Abair | 84/727 |
| 3,983,777 | A | | 10/1976 | Bartolini | |
| 3,983,778 | A | * | 10/1976 | Bartolini | 84/726 |
| 4,184,398 | A | * | 1/1980 | Siegelman | 84/725 |
| 4,220,069 | A | * | 9/1980 | Fender | 84/726 |
| 4,320,681 | A | | 3/1982 | Altilio | |
| 4,524,667 | A | * | 6/1985 | Duncan | 84/728 |
| 4,624,172 | A | * | 11/1986 | McDougall | 84/726 |
| 5,168,117 | A | * | 12/1992 | Anderson | 84/726 |
| 5,221,805 | A | * | 6/1993 | Lace | 84/726 |
| 5,378,850 | A | * | 1/1995 | Tumura | 84/727 |
| 5,389,731 | A | * | 2/1995 | Lace | 84/726 |
| 5,391,831 | A | * | 2/1995 | Lace | 84/726 |
| 5,408,043 | A | * | 4/1995 | Lace | 84/726 |
| 5,530,199 | A | * | 6/1996 | Blucher | 84/728 |
| 5,668,520 | A | * | 9/1997 | Kinman | 336/84 R |
| 5,792,973 | A | * | 8/1998 | Riboloff | 84/726 |
| 5,811,710 | A | * | 9/1998 | Blucher et al. | 84/728 |
| 5,834,999 | A | * | 11/1998 | Kinman | 336/84 R |
| 5,949,014 | A | * | 9/1999 | Rashak et al. | 84/725 |
| 6,103,966 | A | * | 8/2000 | Kinman | 84/728 |

(Continued)

OTHER PUBLICATIONS

Hunter, Duncan et al., "The Guitar Pickup Handbook, The Start of Your Sound"(Backbeat/Hal Leonard, New York, 2008) (total of 260 pages).

(Continued)

*Primary Examiner* — David S. Warren
(74) *Attorney, Agent, or Firm* — Leydig, Voit & Mayer, Ltd.

(57) ABSTRACT

A magnetic pickup for a stringed musical instrument has one or more composite ferromagnetic pole pieces. The composite pole pieces have two or more components with different ferromagnetic materials properties in fixed and contiguous positions. The tonal properties of the pickup are partially determined by the materials and arrangement of the components and are variable over a wide parameter space. Pickups with composite pole pieces and methods for reconfiguring pickup with monolithic pole pieces are described.

39 Claims, 9 Drawing Sheets

U.S. PATENT DOCUMENTS

| | | | | |
|---|---|---|---|---|
| 6,111,185 | A * | 8/2000 | Lace | 84/726 |
| 6,392,137 | B1 * | 5/2002 | Isvan | 84/726 |
| 6,846,981 | B2 * | 1/2005 | Devers | 84/728 |
| 6,998,529 | B2 * | 2/2006 | Wnorowski | 84/726 |
| 7,022,909 | B2 * | 4/2006 | Kinman | 84/726 |
| 7,166,793 | B2 * | 1/2007 | Beller | 84/723 |
| 7,189,916 | B2 * | 3/2007 | Kinman | 84/726 |
| 7,227,076 | B2 * | 6/2007 | Stich | 84/726 |
| 8,178,774 | B2 * | 5/2012 | Salehi | 84/726 |
| 2002/0020281 | A1 * | 2/2002 | Devers | 84/728 |
| 2002/0083819 | A1 * | 7/2002 | Kinman | 84/726 |
| 2004/0003709 | A1 * | 1/2004 | Kinman | 84/728 |
| 2006/0112816 | A1 * | 6/2006 | Kinman | 84/728 |
| 2006/0156911 | A1 * | 7/2006 | Stich | 84/726 |
| 2007/0017355 | A1 * | 1/2007 | Lace | 84/728 |
| 2008/0245218 | A1 * | 10/2008 | Stewart | 84/727 |
| 2010/0005954 | A1 * | 1/2010 | Higashidate et al. | 84/725 |
| 2010/0101399 | A1 * | 4/2010 | Calvet | 84/726 |
| 2010/0122623 | A1 * | 5/2010 | Salo | 84/726 |

OTHER PUBLICATIONS

Milan, Mario, "Pickups, Windings and Magnets and the Guitar Became Electric", (Centerstream, ANaheim Hills, 2007) (total of 216 pages).

French, Richard M., "Engineering the Guitar, Theory and Practice", (Springer, New York, 2009) (total of 274 pages).

Bozworth, Richard M., "Ferromagnetism", (IEEE Press/Wiley, Hoboken, 2003) (total of 492 pages).

Bozworth, Richard M., "Ferromagnetism", (IEEE Press/Wiley, Hoboken, 2003) Second Part of AP (total of 493 pages).

Campbell, Peter, "Permanent Magnetic Materials and their Application" (Cambridge University Press, Cambridge, 1994) (total 218 pages).

Goldman, Alex. Modern Ferrite Technology, 2nd Edition, (Springer, New York, 2006), Part 1 (total pp. 218).

Goldman, Alex. Modern Ferrite Technology, 2nd Edition, (Springer, New York, 2006), Second Part of AS (total pp. 218).

Errede, Professor Steven, Presentation entitled "Electronic Transducers for Musical Instruments", Department of Physics, The University of Illinois at Urban-Campaign, AES Talk, UIUC, Nov. 29, 2005 (43 pages).

Lemme, Helmuth E.W., "The Secrets of Electric Guitar Pickups", updated Feb. 25, 2009, retrieved from http://buildyourguitar.com/resources/leme/ on May 10, 2009 (9 pages).

Sulzer, Mike, "Music Electronics Forum", retrieved from http://music-electronic-forum.com/t13930/ on Sep. 23, 2009 (9 pages total).

Article entitled Common Magnetic Terminology as Used in Specification and Claims of U.S. Appl. No. 12/940,478 retrieved from Wikipedia at http://en.wikipedia.org/wiki/Magnet.

Article entitled "Seymour Duncan Zephyr TM, The Next Great Sound of Guitar" retrieved from http://www.seymourduncan.com/newproducts/zephyr-silver-pickups.php on Oct. 29, 2011 (2 pages).

Ressler, Phil, "Zephyr Silver Background", retrieved from http://www.seymourduncan.com/forum/showthread.php?t=207793 on May 16, 2012 (15 pages).

* cited by examiner

COMPOSITE POLE PIECE MUSICAL INSTRUMENT PICKUP

CROSS-REFERENCE TO RELATED APPLICATION

This application claims priority to U.S. Provisional Patent Applications 61/258,454, "Method for Modifying the Tone of a Musical Instrument Pickup" which was filed on Nov. 5, 2009 and 61/258,912, "Single Coil Pickup with Increased Tonal Range," which was filed on Nov. 6, 2009. Both applications are incorporated herein by reference in their entirety.

FIELD OF THE INVENTION

The present invention relates to pickups for sensing vibrations in a stringed musical instrument and, more specifically, to musical instrument pickups with ferromagnetic pole pieces.

BACKGROUND OF THE INVENTION

String motion sensors, commonly known as pickups, are installed on guitars, bass guitars, mandolins and other stringed musical instruments to convert the sound produced by the vibrating instrument strings to an electronic signal. In various applications, the electronic signal generated by the pickup may be modified using analog and digital signal processing techniques, amplified, and recorded on a suitable sound recording medium before being converted back to a sound signal by a speaker or other output transducer. Conventional musical instrument pickups use different physical principles, including variations in magnetic reluctance, the Hall effect and the piezoelectric effect, to detect the motion of ferromagnetic strings.

Magnetic reluctance pickups typically comprise one or more ferromagnetic pole pieces, a magnetic source, and a coil with output terminals that surrounds the pole pieces. When the pickup is positioned near the ferromagnetic strings of a musical instrument the magnetic source, pole pieces and strings may be modeled as a magnetic circuit with a magnetic flux in each of the elements. The magnetic flux in a pole piece is partially dependent on the distance between the string-sensing surface of the pole piece and a string. String vibrations change the pole-to-string distance and the pole piece flux. The coil surrounding the pole pieces is said to link the flux in the pole pieces and an electromagnetic force is developed in the coil when the magnetic flux changes. An electronic signal is developed at the output terminals of the coil in response to the electromotive force.

The frequency-dependent response function of a magnetic musical pickup is nonlinear and the input string-motion signal is distorted by the pickup in the process of converting it to an electronic signal. This distortion imparts certain tonal attributes to the string-sensing process and, when properly controlled, adds desirable and highly musical qualities to the output signal.

Magnetic reluctance pickups came into common usage during the 1950's when hard ferromagnetic material and sensor technologies evolved to a point that the pickups could be economically mounted on a musical instrument. Magnetic pickups have been developed for many different instruments and a significant commercial market exists for magnetic guitar pickups. For purposes of clarity, the features of the present invention will be discussed with reference to a 6-string guitar with ferromagnetic strings. It will, however, be obvious to those skilled in the art that the scope of the invention is not limited to 6-string guitars and magnetic pickups that embody features of the invention may be mounted on many different instruments. Other instruments that are commonly equipped with magnetic pickups include, but are not limited to, 12-string guitars, bass guitars, mandolins, and steel guitars.

Magnetic musical instrument pickups may classified into broad categories that reflect differences in basic design and tonal quality. Pickups in the 'single coil' category have key design features that are shared by the pickups disclosed in U.S. Pat. No. 2,612,072 issued to H. de Armond on Sep. 30, 1952, U.S. Pat. No. 2,573,254, No. 2,817,261, No. 3,236,930, and No. 4,220,069 respectively issued to Leo Fender on Oct. 30, 1951, Dec. 24, 1957, Feb. 22, 1966, and Sep. 2, 1980 and U.S. Pat. No. 2,911,871 issued to C. F. Schultz on Nov. 10, 1959. The 'single coil' name derives from the fact that pickups in this category comprise a set of string-sensing ferromagnetic pole pieces with a magnetic flux that is linked by a single, string-sensing coil of wire. Some single coil pickups have pole pieces that are formed from magnetized hard ferromagnetic materials that generate the flux in the pickup. In other single coil designs a separate permanent magnet induces magnetic fields in the pole pieces. Single coil pickups have no means for external noise rejection and are sensitive to external electromagnetic noise sources.

The external noise sensitivity of a magnetic pickup may be significantly reduced by adding a second wire coil to the pickup. The second coil is designed to generate an electronic output signal at its terminals with a noise component that is similar to the noise output of a first coil. Noise reduction is accomplished by connecting the first and second coils so that the noise signals from the two coils have opposite phases.

Noise-reducing humbucking pickups or 'humbuckers' share key design features with the devices that are disclosed in U.S. Pat. No. 2,896,491 ('491) issued to Seth Lover in Jul. 28, 1959 and U.S. Pat. No. 2,892,371 issued to J. R. Butts on Jun. 30, 1959. Pickups in this class have at least two-string sensing coils, each linked to a separate set of string-sensing pole pieces. The magnetic field direction in the poles and the direction of signal propagation within the coils are selected so that a large portion of the string-generated signals from the two are coils have an in-phase, additive relationship and a large percentage of the common-mode noise signals from the two coils have an out-of-phase, subtractive relationship. Split-blade designs such as the Lindy Fralin Split-blade pickups manufactured by Lindy Fralin of Richmond, Va. also fall into the 'humbucking' category. In most cases, the amplitude of the output signal of a humbucking pickup is greater than that obtained from a single coil pickup and the output noise signal is significantly reduced.

Noise-cancelling single coil pickups have tonal characteristics similar to those of single coil pickups and comprise a single set of string-sensing pole pieces, a string sensing coil and a noise cancelling coil that is connected to the string-sensing coil. Illustrative noise-cancelling single coil pickups are disclosed in U.S. Pat. No. 7,166,793 issued to Kevin Beller on Jan. 23, 2007, U.S. Pat. No. 7,189,916 issued to Christopher I. Kinman on Mar. 13, 2007, and U.S. Pat. No. 7,227,076 issued to Willi L. Stich on Jun. 5, 2007.

The design and manufacture of magnetic musical instrument pickups are described from an historical and lay engineering perspective in *The Guitar Pickup Handbook, the Start of Your Sound* by Duncan Hunter (Backbeat/Hal Leonard, New York, 2008) and *Pickups, Windings and Magnets and the Guitar Became Electric*, by Mario Milan (Centerstream, Anaheim Hills, 2007). On a more technical level, *Engineering the Guitar, Theory and Practice* by Richard Mark French (Springer, New York, 2009) contains a chapter on Guitar Electronics and a thorough treatment of musical sound quality and tone as viewed from an engineering and physics perspective.

BRIEF SUMMARY OF THE INVENTION

In some embodiments, magnetic musical instrument pickups according to the invention have one or more string-sensing composite pole pieces. Each composite pole piece has two or more ferromagnetic components with different material properties and is assembled so that one surface of each ferromagnetic component is fixed in a contiguous position with respect to a surface of a different ferromagnetic component. In contrast to conventional pole pieces that are formed from one or more pieces of a single material, the integrated ferromagnetic properties of a composite pole piece may be engineered over a wide parameter space to obtain desirable tonal characteristics from a pickup in which they are mounted.

The ferromagnetic components of a composite pole piece may be formed from hard or soft ferromagnetic materials. The magnetization states of hard ferromagnetic components may vary over a wide range and, in some cases, a hard ferromagnetic component may be unmagnetized.

Depending on the component shapes and pole piece design, the contiguous surfaces of component pieces may be approximately parallel or perpendicular to a plane that is tangent to a string-sensing surface of the composite pole piece at its center. Composite pole piece components may be held in fixed relative positions by joining the pieces together or pole piece components may be held together by mechanical pressure. Soldering, bonding with an adhesive, and other known techniques may be used to join the components. In some cases, the bonding materials may be electrically conductive and/or magnetically permeable.

In further embodiments, the invention is a magnetic pickup that comprises a first set of pole pieces, each having a string-sensing surface, a magnetic device that generates a magnetic field in the set of pole pieces, and at least one string-sensing wire coil with output terminals that links a magnetic flux in the first set of pole pieces. The set of pole pieces may be magnetized and, in such cases, they are at least a component of the magnetic device.

The first set of pole pieces may comprise two or more composite pole pieces. Multiple composite pole pieces may have similar components or they may have components that differ in material properties or volume ratio. In certain embodiments, all of the pole pieces are magnetic composite pole pieces and each composite pole piece has a string-sensing surface that is the surface of a permanent magnet component.

Noise cancelling pickups according to the invention comprise a first set of string-sensing pole pieces, a string-sensing wire coil, a second wire coil that is connected to the string-sensing coil in a noise-cancelling configuration and a magnetic flux source. In humbucking embodiments, the second wire coil surrounds a second set of string-sensing pole pieces and, in noise-cancelling single coil embodiments, the second coil is in electromagnetic communication with a set of passive pole pieces that do not sense string motion.

Other pickups embodying the invention comprise a first set of string-sensing pole pieces, a string-sensing wire coil, a magnetic device that generates a magnetic field in the pole pieces, and a mechanical assembly that holds the pole pieces, coil and magnetic device in a stable configuration. In some cases, the assembly comprises a body for holding at least one composite pole piece component and a removable component holder that applies mechanical pressure in a direction that is normal to the contiguous component surfaces when the component holder is fastened to the body.

In further embodiments the invention provides methods for changing the tone of an existing pickup by reconfiguring at least one monolithic pole piece as a composite pole piece. In certain embodiments, one or more monolithic pole pieces are reconfigured by replacing them with composite pole pieces and, in alternative embodiments, they are reconfigured by adding pole caps.

DESCRIPTION OF THE EMBODIMENTS

Figure 1:
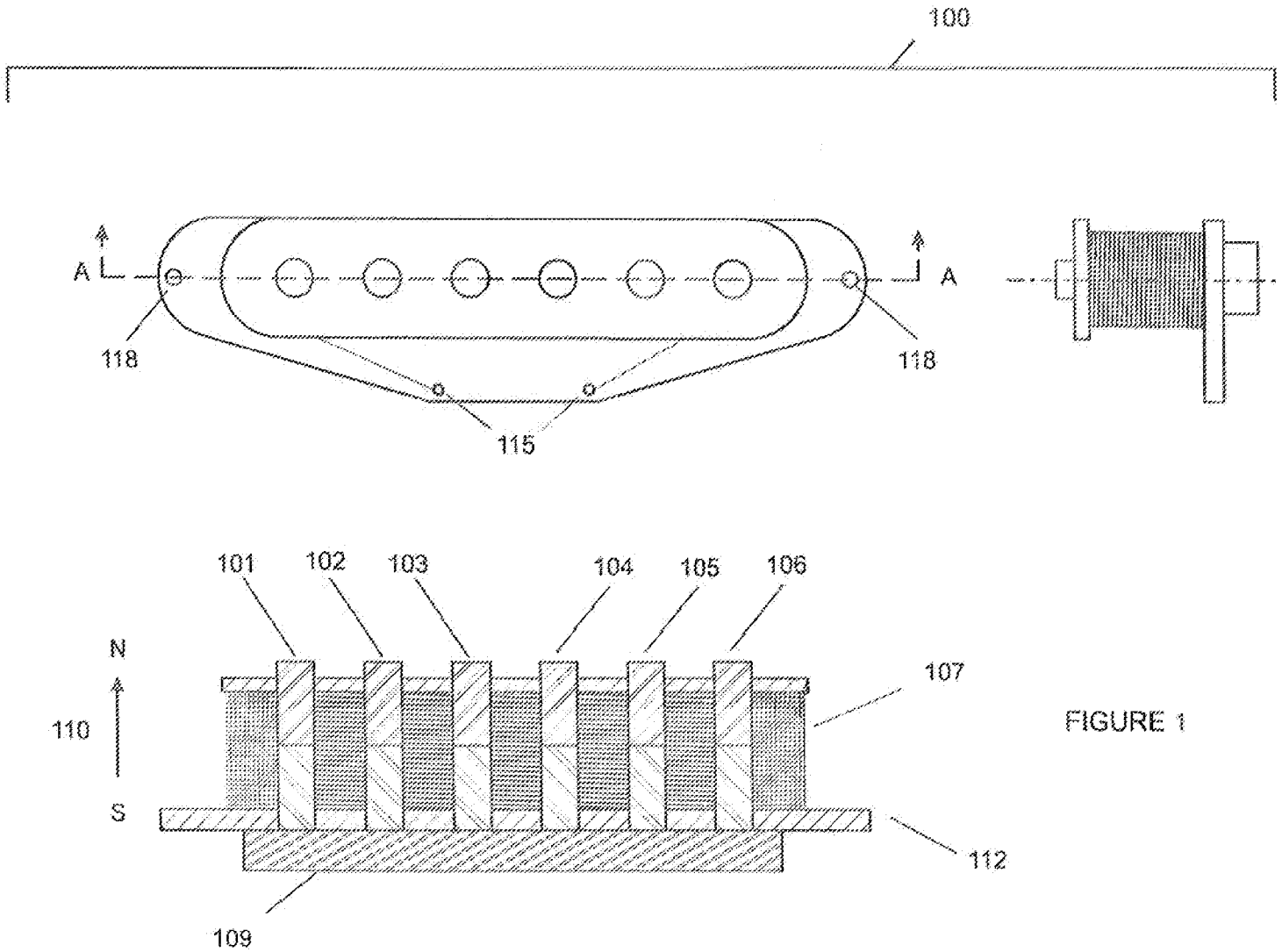
FIG. 1 is a sectioned orthographic projection drawing of a Stratocaster-style single coil pickup with composite pole pieces.

Magnetic musical instrument pickups are commonly used to sense the motion of strings on a guitar, bass guitar, pedal steel guitar or other stringed musical instrument. When mounted near a ferromagnetic string, a magnetic pickup generates an electronic signal that varies with the string motion. The amplitude of the signal and the fidelity with which it represents the spectrum of the string vibrations are dependent on the detailed design features of the pickup. Typically, the fidelity is not high and it is common practice to describe the distortions introduced by a pickup by attributing a 'musical tone' or a 'tonal quality' to the device.

The terms 'musical tone,' and 'tonal quality' are commonly used by those skilled in the art of musical instrument and pickup design to refer to a set of physical parameters that determine the musical qualities of the sound emanating from an instrument or component as perceived by a human observer. In this provisional application, the terms 'pickup tone,' 'tonal quality,' and 'sound quality' will be used interchangeably to describe the contributions of the pickup to the perceptual features of a sound generation process. This process typically includes the conversion of the sound produced by the vibrating strings of the instrument to an electronic signal that passes through one or more signal processing and amplification stages before being converted to sound by a speaker. Because it senses string motion and generates the electronic signal that is amplified and modified by downstream components, the sound quality of a pickup plays a significant role in determining the overall tone of an amplified instrument. Sound qualities that are lost in the conversion of string motion to an electronic signal cannot be regenerated in subsequent signal processing and amplification stages.

According to R. M French in the chapter of *Engineering the Guitar, Theory and Practice* entitled "Sound Quality" (pp 180-207, Springer, New York, 2009), "few topics are more controversial than sound quality. Skilled players and experienced listeners generally agree on subjective rankings of instruments, but the differences are notoriously difficult to measure and to describe using objective metrics." Like flavor, artistic quality, and other variables that describe the properties of an item in terms of its effect on human perception, good sound quality and tone are readily recognized by a knowledgeable individual but impossible to completely quantify using physical measurement parameters.

Magnetic instrument pickups generate an output signal when the magnetic flux in one or more string-sensing ferromagnetic pole pieces changes in response to the motion of an instrument string. The pole pieces have magnetic fields that may be self-generated or induced by an external permanent magnet. In a typical magnetic pickup, the flux in the pole pieces is linked by a wire coil and an output signal is generated by the coil in response to string-induced flux variations.

It is well-known within the prior art that pickup tone is affected by the basic pickup design, by the number of turns, wire tensions and winding patterns of the constituent wire coils and by the shape, material and magnetization state of pole pieces and permanent magnets. There is a general understanding of the tonal attributes of monolithic pole pieces that are fabricated from commonly-used permanent magnet materials and steels but a detailed theory relating the tone of a pickup to the ferromagnetic properties of the pole piece materials has yet to be developed. While the qualitative tonal differences between a Stratocaster-style single coil pickup with fully magnetized Alnico 5 pieces and an identical pickup with fully magnetized Alnico 3 pole pieces are well-known, an understanding of these differences in terms of the fundamental electromagnetic material properties of the pole piece materials, including eddy current and hysteresis losses, recoil permeability, coercivity, and residual induction is lacking.

In embodiments of the invention, the tonal properties of a pickup are shaped, at least in part, through the use of one or more composite pole pieces. The composite pole pieces comprise two or more ferromagnetic components and have integrated ferromagnetic properties that may be engineered over a wide parameter space. Pickups that include one or more composite pole pieces typically have tonal attributes that are difficult or impossible to obtain using monolithic pole pieces that are fabricated from a single material.

In pickups embodying the invention, the ferromagnetic properties of composite pole piece components may differ with respect to one or more parameters. One such parameter is the ability of a component to be magnetized as a permanent magnet. Hard ferromagnetic materials differ from soft ferromagnetic materials in at least this respect. Ferromagnetic material properties are described in numerous texts including *Ferromagnetism* by Richard M. Bozorth (IEEE Press/Wiley, Hoboken, 2003), *Permanent Magnetic Materials and their Application* by Peter Campbell (Cambridge University Press, Cambridge, 1994) and *Modern Ferrite Technology*, $2^{nd}$ Edition by Alex Goldman (Springer, New York, 2006).

As described in these books and elsewhere, pole piece components formed from hard or soft ferromagnetic materials may differ in their ferromagnetic loss coefficients. Ferromagnetic losses are frequency dependent and are commonly described by three material-dependent coefficients: a hysteresis coefficient, an eddy current coefficient and an anomalous loss coefficient.

Hard ferromagnetic component materials may also differ in the shape of their demagnetization curves, the shape of minor hysteresis loops along the demagnetization curve, and in the values of parameters that describe these shapes. Such parameters include, but are not limited to, maximum energy product, recoil permeability, coercive force or coercivity, residual induction and required magnetizing field. Soft ferromagnetic materials may differ in the shape of their magnetization curves, hysteresis loops, and permeability curves and in values of parameters that are derived from them. Such parameters include but are not limited to permeability, incremental permeability, saturation induction, coercive force, residual induction, coercivity and retentivity.

FIG. 1 illustrates a sectioned orthographic projection drawing of a single coil pickup 100 that embodies features of the invention. In the sectional front view, the pickup is cut with the plane AA. The pickup 100 has six composite pole pieces, 101-106, and each pole piece has components with similar dimensions and material properties. The pickup also has a permanent magnet 109 that induces a magnetic flux in the pole pieces 101-106 and a single wire coil, 107 that links the flux. The pole pieces 101-106, coil 107 and magnet 109 are stably supported by the plastic bobbin 112. The poles of the magnet 109 are oriented vertically in the direction 110 and the upper pole is attached to the bottom surface of the plastic bobbin 112 with an adhesive. The bottom surfaces of the composite pole pieces 101-106 contact the upper pole of the magnet 109. The wire coil 107 is wound with #42 solderable polyurethane nylon (SPN) and has a resistance of approximately 6000 Ohms. The ends of the wire coil 107 are soldered to metal ferrule output terminals 115 in the bobbin 112. The holes 118 in the bottom plate of the bobbin 112 have the spacing and thread required for mounting on the pickguard of a Fender Statocaster guitar.

Figure 2:
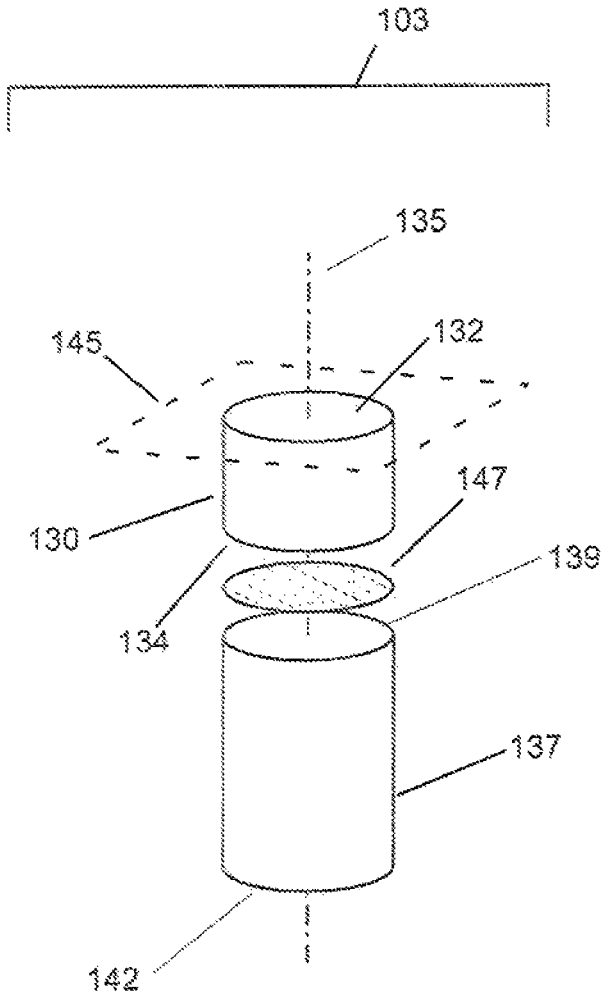
FIG. 2 is an exploded view of a representative composite pole piece in the single coil pickup of FIG. 1.

FIG. 2 is an exploded view of the pole piece 103 that is representative of the composite pole pieces 100-105 in the pickup 100. The representative pole piece 103 has an upper component 130 that is fabricated from Alnico 5 and a lower component 137 that is fabricated from Material 77 soft ferrite that is manufactured by Fair-Rite of Walkill, N.Y. Material 77 has a medium permeability and low ferromagnetic losses at frequencies below 20 kHz. The upper Alnico 5 component 130 is typically magnetized in a direction that is approximately parallel to the pole piece axis 135. The upper surface 132 of the component 130 is the string-sensing surface of the pole piece 103 and the lower surface 134 is bonded to the upper surface 139 of the lower component 137 with an adhesive layer 147. The upper surface of the upper component 130 defines a string-sensing surface tangent plane 145 and the contingent surfaces 134 and 139 are approximately parallel to the tangent plane 145.

In this application, the string-sensing surface of a pole piece is defined as the surface that is closest to a string when the pickup is mounted in an instrument. In pole pieces with a planar string sensing surface, the string-sensing surface tangent plane is defined by and includes the string-sensing surface. In pole pieces with curved or beveled string-sensing surfaces, the string-sensing surface tangent plane is tangent to the surface at a center point.

In an experimental prototype of the pickup 100, the pole pieces had the same components and the design of the representative pole piece 103 illustrated in FIG. 2. The Alnico 5 upper component 130 of each of the pole pieces 101-106 had a diameter of approximately 0.188 inches and a length of approximately 0.188 inches. The ferrite lower component 137 of each pole piece had a diameter of approximately 0.188 inches and a length of approximately 0.50 inches. The components 130, 137 of each pole piece 101-106 were joined with cyanoacrylate cement layer 147 and were held in the bobbin 112 using a mixture of 20% beeswax and 80% paraffin.

The magnetic field at the string-sensing surface 132 of each of the pole pieces 101-106 was partly self-generated by the magnetized Alnico 5 component 130 and a partly induced by the permanent magnet 109. The permanent magnet 109 was fabricated from ceramic 7 material and had a thickness of approximately 0.25 inches in the magnetization direction. The cross section was approximately rectangular with a width dimension of approximately 0.5 inches and a length dimension of approximately 2.5 inches. In alternative embodiments, the permanent magnet 109 may be formed from any magnetized hard ferromagnetic material including bonded and flexible hard magnetic materials.

The design of the representative Alnico 5/ferrite composite pole piece 103 illustrated in FIG. 2 is but one example of a wide range of pole piece designs and composite materials that may be used to shape the tone of a single coil pickup as illustrated in FIG. 1. Because the permanent magnet 109 induces a magnetic field in the pole piece, there is no restriction on the magnetization state of the contiguous components of the composite pole pieces 101-106 and they may be formed from any ferromagnetic material, including hard ferromagnetic materials that are unmagnetized before mounting in the pickup. Unmagnetized hard ferromagnetic materials may be slightly magnetized by the permanent magnet 109 when they are mounted in the pickup but the magnetization is much smaller than the magnetization of magnetized hard material. Limited only by the practicalities of cost and complexity, each of the composite pole pieces 101-106 in alternative embodiments of the pickup 100 may have 3 or more components with different shapes.

Figure 3:
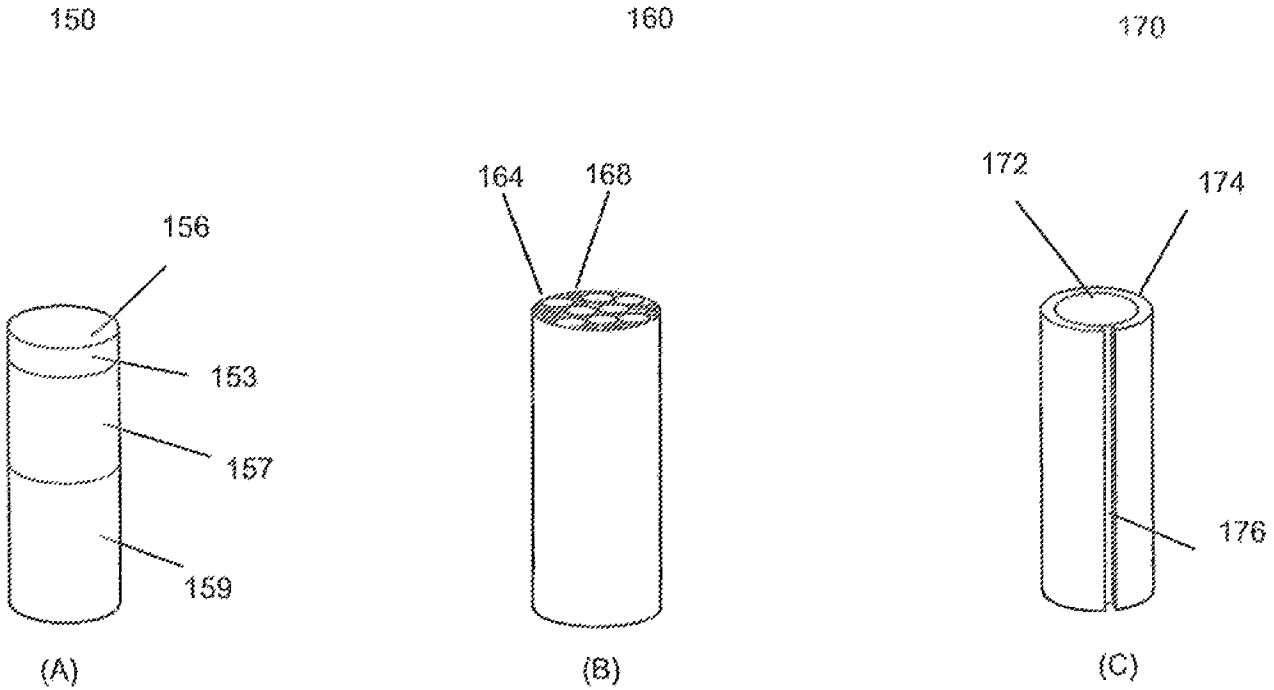
FIG. 3 illustrates alternative composite pole piece designs that may be used in the single coil pickup of FIG. 1.

In alternative embodiments, the pole pieces 101-106 of the pickup 100 may have different designs as illustrated in FIG. 3. In the capped pole piece design 150 of FIG. 3(A), the uppermost component 153 is a thin disc or pole cap. Pole caps typically have a thickness of less than 0.125" and are often fabricated by punching a circularly-shaped piece from a thin sheet of material. The effect of a pole piece component on tone decreases with distance from the string-sensing surface 156 of the pole piece 150 and, for this reason, a set of comparatively thin pole caps can significantly modify the tone of a pickup. As illustrated in FIG. 3(A) the portion of the composite pole piece below the pole cap is a composite structure with two components 157,159 that have approximately the same length and diameter.

In one realization of the design that is illustrated in FIG. 3(A), the body component 157 is formed from 1010 carbon steel and the component 159 is formed from ferrite Material 77. The material of the pole cap 153 is chosen to color the basic tone of the steel/ferrite body. Suitable pole cap materials include, but are not limited to ultralow carbon steels, tool steels, spring steels, soft ferrites, nickel alloys, cast or sintered alnico alloys, machinable hard ferromagnetic materials including alloys of FeCrCo or CuNiFe, flexible or bonded hard ferromagnetic materials, and 'homemade' bonded soft ferromagnetic materials that are made by loading an epoxy or RTV, for example, with one or more powdered ferromagnetic materials. An inexpensive 'homemade' bonded material with useful tonal properties can, for example, be quickly produced by loading 5-minute epoxy with iron filings.

The composite pole piece design 160 of FIG. 3(B) is a wire pole piece that comprises two or more types of ferromagnetic wire 164,168. The radial surfaces of at least one wire of a first type is held in a fixed and contiguous relationship to a radial surface of at least one wire of a second type with an adhesive that may, in various embodiments, be insulating, conductive and/or ferromagnetic. Suitable ferromagnetic wire materials include, but are not limited to, nickel wire, ferromagnetic resistance wire, ferritic and martenistic stainless steel wires, carbon steel wires with various carbon content including 1008 alloy and music wire, and high permeability wires including vanadium permendur and permalloy wires. The eddy current losses of the pole piece may be varied over a wide range by selecting the diameter of the wires and/or by adjusting the electrical conductivity of the contiguous surface interfaces. For example, small eddy current losses may be obtained by using small diameter wire (AWG #30 or smaller, for example) and coating the surface of each wire with an insulating varnish. The eddy current losses may also be controlled by including nonferromagnetic wires in the wire bundle. Wire pole pieces having a small cross-sectional dimension are easily manufactured and are well-suited for use in embodiments with blade- and rail-shaped composite pole pieces.

Composite pole pieces may also comprise two or more concentric cylindrical components. The concentric composite pole piece design 170 that is illustrated in FIG. 3(C) comprises and inner cylinder 172 and an outer sleeve 174 that are fabricated from two different ferromagnetic materials. Eddy current losses in the outer sleeve 174 may be reduced by one or more slits 176 in the sleeve. In a representative example, of this pole piece design, the inner cylinder may be formed from ferrite Material 77 and the outer cylinder may be formed from a ferritic stainless steel alloy.

In some embodiments of the invention, the component pieces of the composite pole pieces may have different designs or shapes. For example, a composite pole pickup may have one or more pole pieces with the design of FIG. 3(A) in which at least one of the components 157,159 is a wire bundle. In certain stacked designs that are similar to the designs of FIG. 2 and FIG. 3(A), a pole piece may have more than three components and/or the cross sectional shapes of the components in a pole piece may be different. Apart from the basic requirements that two or more of the component pieces be formed from ferromagnetic materials with different ferromagnetic materials properties and occupy fixed and contiguous positions, the designs of the composite pole pieces in pickups embodying the invention are only limited by the pragmatics of cost and manufacturability.

Figure 4:
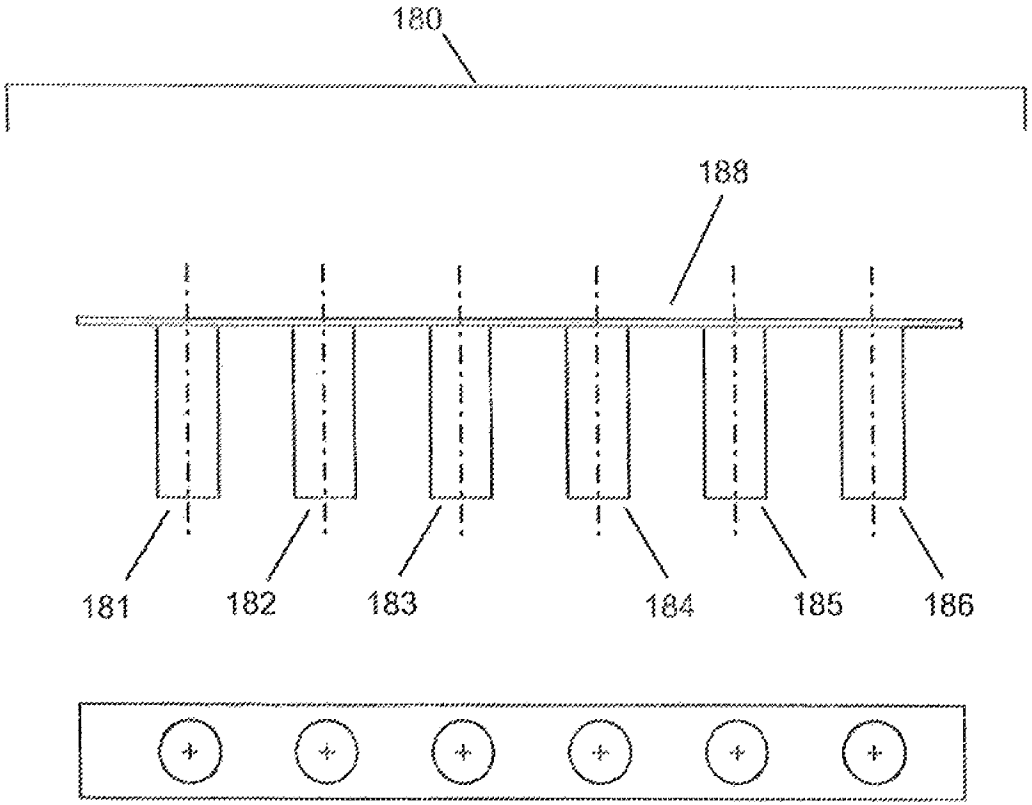
FIG. 4 illustrates a composite pole piece with a single rectangular component that is attached to six cylindrical components.

In alternative embodiments, a single pole cap may be attached to more than one pole piece. FIG. 4 illustrates a pole set 180 consisting of rectangular pole cap 188 and 6 pole bodies 181-186 that are attached to the bottom surface of the cap. A pole piece set 180 in which the pole bodies 181-186 have dimensions and spacings that are matched to mounting holes in the bobbin 112 may be used in the single coil pickup of FIG. 1. The bodies may be formed, for example, from a ferrite ceramic such a Fair-Rite Material 77. The rectangular pole cap 188 is typically attached to the pole pieces using cyanoacrylate cement or other suitable adhesive and, in different exemplary embodiments, may be formed from 0.020" thick unmagnetized ArnoKrome 3, 0.015" thick alloy 1008 carbon steel, or 0.030 thick ferritic stainless steel. ArnoKrome 3 is the trade name for a machinable hard ferromagnetic alloy that is manufactured by the Rolled Products Division of Arnold Magnetics in Marengo, Ill.

Figure 5:
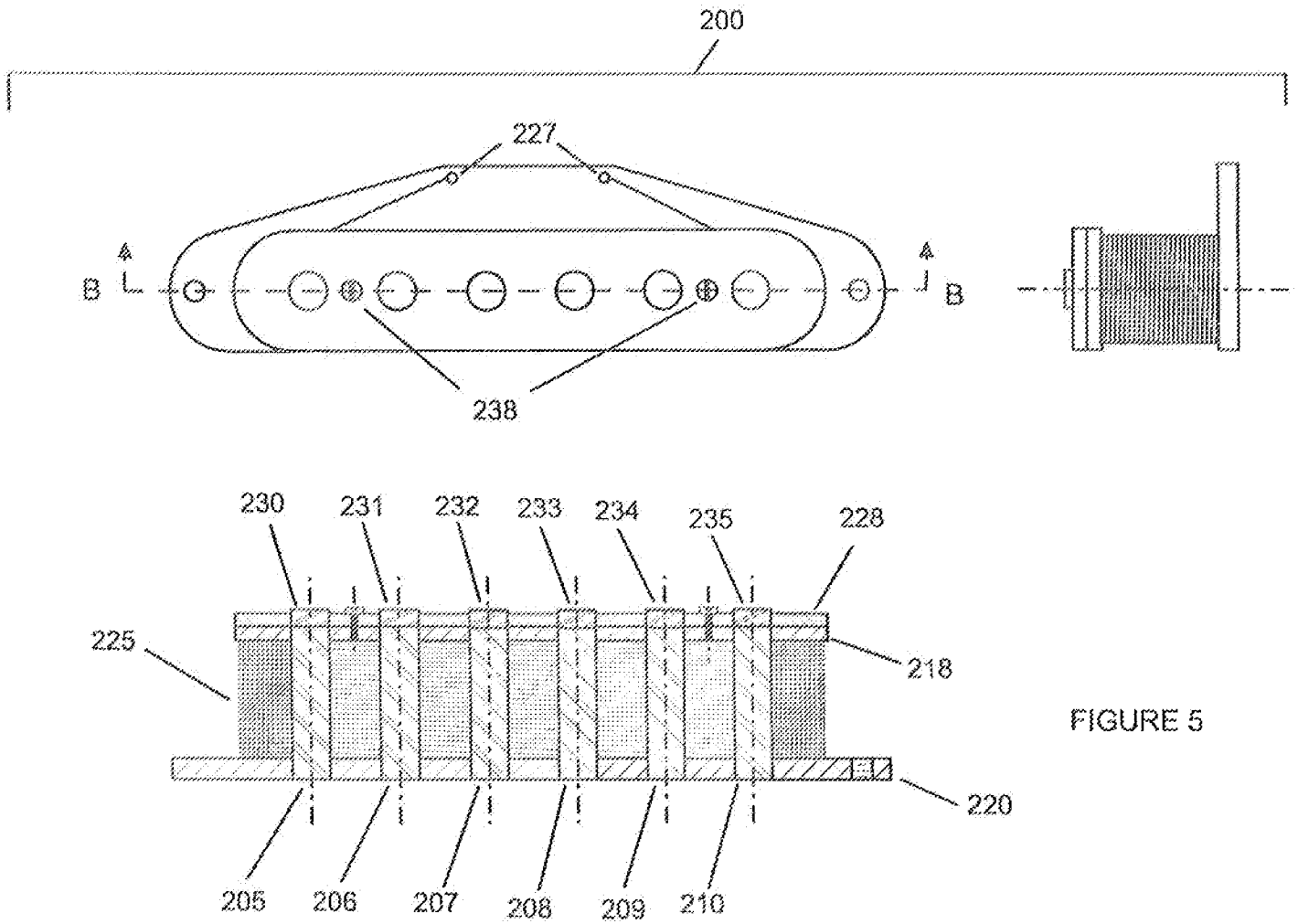
FIG. 5 is a sectioned orthographic projection drawing of a single coil pickup with pole caps that are mounted in a removable holder that is fastened to a body.

FIG. 5 is a sectioned orthographic projection drawing of an alternative single coil embodiment 200 in which the pole piece bodies 205-210 are magnetized. In this pickup the magnetic flux is generated by the pole pieces and there is no external magnet. The pole piece bodies are pressed into holes in a upper vulcanized fiberboard end piece 218 and a lower vulcanized fiberboard end piece 220. The lower end cap 215 has holes for mounting the pickup 200 in a 6 string guitar. The wire coil 225 is wound directly on the pole pieces 205-210 and the coil ends are attached to metal ferrule output terminals (not shown) in the lower end piece 215. As illustrated in FIG. 5, the pole piece bodies 205-210 are formed from a single material such as Alnico 2, 3, or 5 but, in alternative embodiments, the bodies of different pole pieces may be formed from different single materials or one or more of the pole piece bodies may have a composite structure comprising 2 or more dissimilar materials.

Pole caps 230-235 are mounted in a pole piece holder 228 using a conventional adhesive that may be, for example, cyanoacrylate cement, an epoxy, or a flexible adhesive such as RTV. The holder 228 is attached to the upper end piece 218 with conventional fasteners 238 that allow the holder 228 and pole caps 230-235 to be easily replaced. In a typical application, a musician may have one or two pickups and several different pole cap sets, each optimized for a different style of music.

In an exemplary realization of the FIG. 5 design, the pole piece bodies are 0.187 dia.×0.688 long cylinders of Alnico 5 and the end pieces are a vulcanized gray fiberboard Stratocaster flatwork set manufactured and sold by Mojo Musical Supply of Burgaw, N.C. The wire coil has a resistance of approximately 5600 Ohms and is wound with #42 solderable polyurethane nylon (SPN) wire. The pickup body 210 and pole cap 235 are designed sense the motion of the low E string when the pickup 200 is mounted in a Stratocaster guitar. All pole caps have a diameter that is approximately equal to the diameter of the pole piece on which they are mounted. Pole caps 230 and 231 are composite pole caps with an upper component that is a 0.020 thick disc of unmagnetized ArnoKrome 3 and a lower component that is a 0.030 thick disc of Fair-Rite Material 77, pole caps 232 and 233 are 0.040" thick discs of partially magnetized Alnico 2, pole cap 234 is a 0.050 thick disc of unmagnetized ArnoKrome 3, and pole cap 235 is a 0.020 thick disc of unmagnetized ArnoKrome 3.

Figure 6:
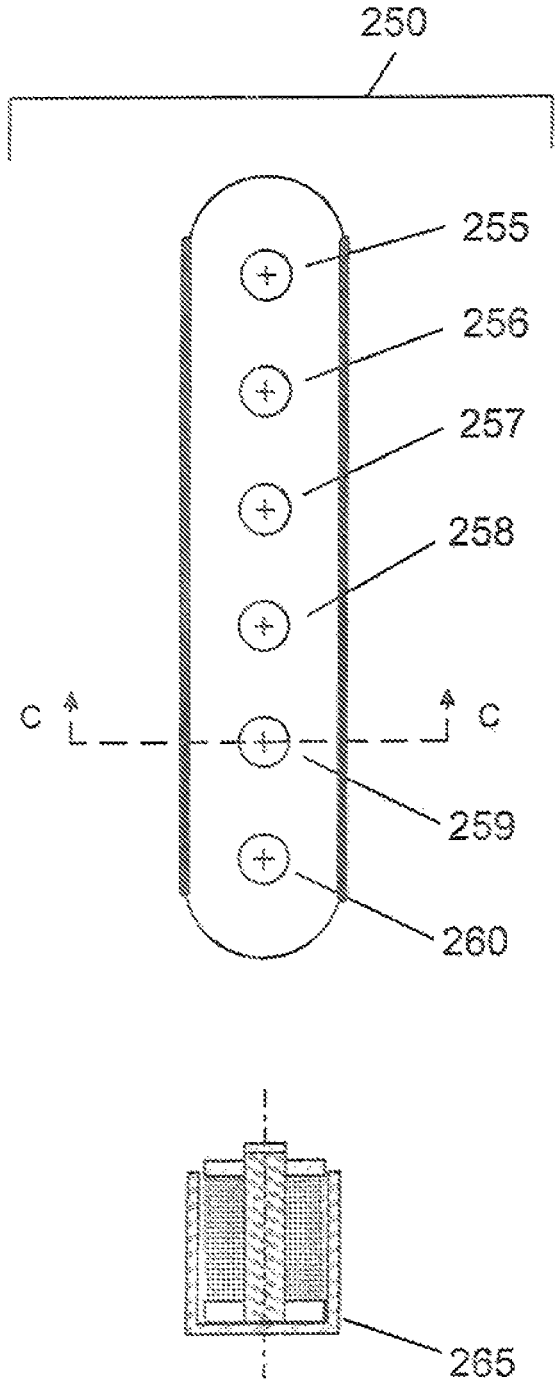
FIG. 6 is a sectioned orthographic projection drawing of a single coil pickup with magnetic pole caps and a keeper bar.

In some magnetic pickups with magnetized pole pieces, keeper bars are used to shape the magnetic field distribution above the pickup. Composite magnetic pole pieces in which the magnetic field is generated by magnetized pole caps offer unique advantages in these designs. FIG. 6 is a sectioned two-view orthographic projection drawing illustrating a single coil pickup 250 in which a ferromagnetic keeper bar 265 is used to widen the magnetic field above the pickup. In conventional designs, the pole pieces are formed from an alloy of alnico and the keeper bar 265 is formed from a low carbon steel alloy. Low carbon steel is a medium permeability material with significant hysteresis and eddy current losses that reduce the efficiency of the pickup 250.

In a novel embodiment of the invention, the pole pieces 255-260 are composite pole pieces with permanent magnet pole caps. The permanent magnet pole caps may advantageously be thin discs of a flexible or bonded permanent magnetic material. The bodies may be monolithic structures that are formed from a single material or they may be composite structures with one or more cylindrical components. In an exemplary realization, the pole caps are 0.060" thick discs of standard Ultramag flexible magnetic material manufactured by the Flexmag Division of Arnold Magnetics in Marietta, Ohio and the bodies are two-component structures as illustrated in FIG. 2. The upper body component may be fabricated from unmagnetized alnico alloy such as Alnico 5 and the lower component from a medium permeability ferrite such as Fair-Rite Material 77. In composite pole pieces of this design with an outside diameter of 0.187" and a total length of approximately 0.688" the magnetic flux density at the bottom of the pole piece is quite small. Consequently, the keeper bar can be advantageously formed from permalloy or other high permeability materials that saturate at the magnetic field levels generated by conventional monolithic pole pieces. The eddy current losses of a permalloy keeper bar may also be advantageously reduced if the bar is formed by bonding small diameter permalloy wires (AWG #30 or smaller, for example) that are coated with an insulating varnish. The eddy currents are typically minimized in a bonded wire keeper bar by orienting the wires so that their length directions are parallel to the outer surfaces of the composite pole pieces 255-260.

Figure 7:
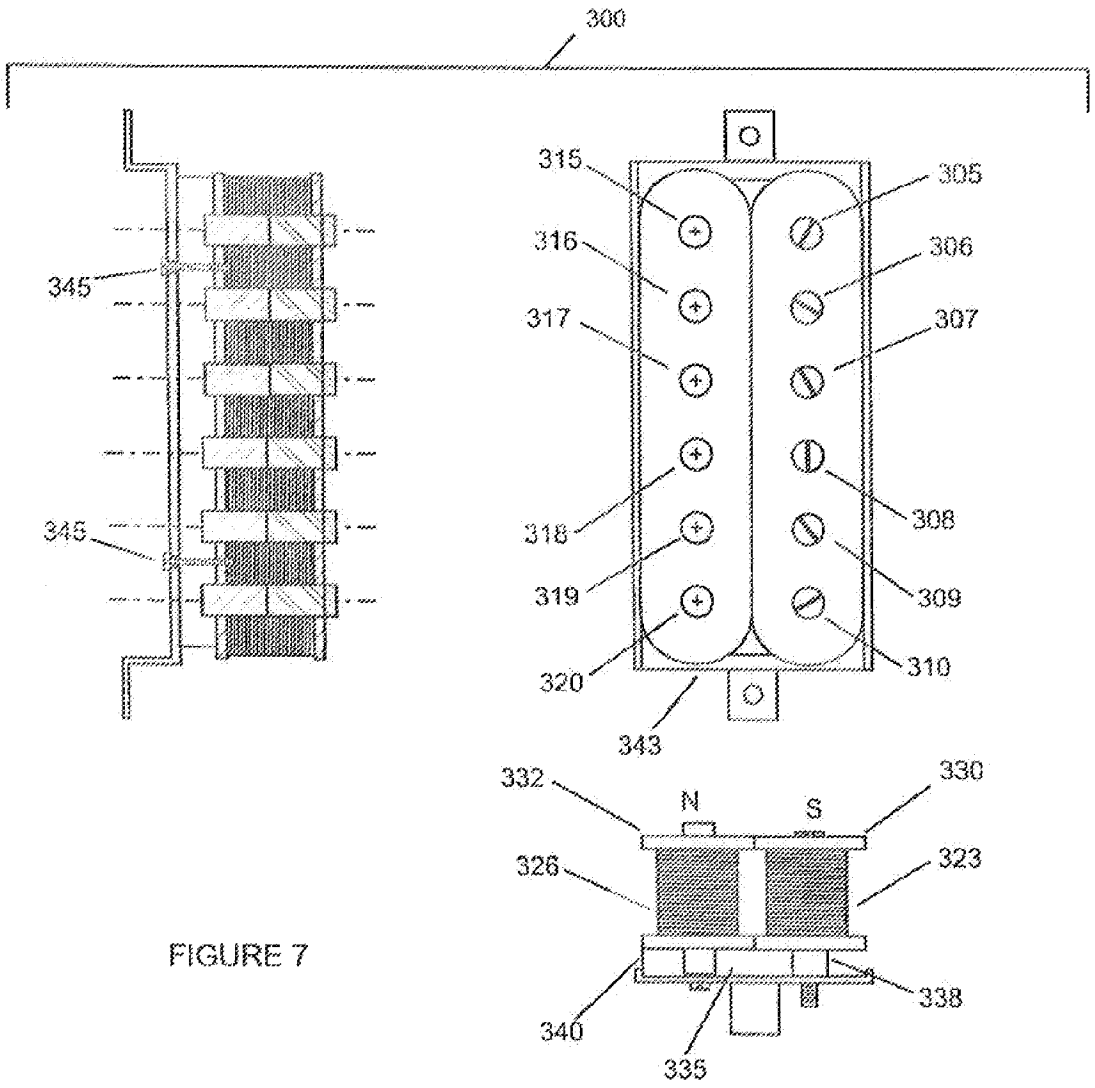
FIG. 7 is a sectioned orthographic projection drawing of a humbucking pickup with composite pole pieces.

FIG. 7 is a sectioned orthographic projection drawing illustrating a composite pole piece humbucking pickup 300 according to the invention. In contrast to the single coil pickups of FIG. 1 and FIG. 3, the humbucking pickup 300 has two set of string-sensing pole pieces 305-310 and 315-320 that are surrounded by separate wire coils 323, 326. In the illustrated embodiment, the pole pieces 305-310 are conventional low carbon steel fillister head screws and the pole pieces 315-320 are capped composite slug pole pieces having the design 150 of FIG. 3(A). The wire coil 323 is wound on a bobbin 330 which also has six threaded six holes that are matched to the screw pole pieces 305-310. Conventionally the screw pole pieces have a 5-40 thread. The wire coil 326 is wound on the bobbin 332 which has six holes for mounting the composite slug pole pieces 315-320. The diameters of the holes in the bobbin 332 are typically chosen so that the fit between the composite slug pole pieces 315-320 and the bobbin 332 is a tight press fit. The wire coils are commonly wound in the same direction (clockwise or counterclockwise) and connected in a series with the 'finish' end of the screw coil connected to the 'finish' end of the slug coil. The slug pole pieces typically have a diameter of 0.187" and a length of approximately 0.490."

Magnetic fields of opposite direction are induced in the pole piece sets 305-310 and 315-320 by the permanent magnet 335. The magnetic field in the bar magnet 335 is parallel to the large face of the magnet 335 in the shorter (width) direction. A keeper bar 338 is in contact with the south pole of the magnet 335 and has clearance holes for the screw poles that are positionally matched to the threaded holes in bobbin 330. The keeper bar increases the magnetic coupling between the screw pole pieces 305-310 and the magnet 335. The composite slug pole pieces 315-320 typically contact the north pole of the permanent magnet along their diameters. The bobbin 332 is supported by a spacer 340 and secured to a baseplate 343 by screws 345.

In one example, the pole caps on the composite slug pole pieces 315-320 are 0.187" dia.×0.020" thick discs of CMI-B ultralow carbon magnetic iron manufactured by CMI Specialty of Bristol, Conn. The body of each slug has a length of approximately 0.470" and a diameter of 0.187" and consists of an upper component that is fabricated from a high carbon music wire and a lower component that is fabricated from low carbon steel alloy such as 1018 alloy. The body components have approximately equal length. The body components and pole caps of each of the composite slug pole pieces are joined together with cyanoacrylate cement or an alternative conventional adhesive.

In alternative embodiments the slug pole pieces 315-320 may comprise at least one conventional monolithic, single material pole piece and one or more composite pole pieces. In embodiments with a multiplicity of composite pole pieces, two or more of the composite pole pieces may have the same designs and materials combined in the same volume ratios.

Alternatively, two or more composite pole pieces may differ with respect to design, component materials and/or volume ratios.

Figure 8:
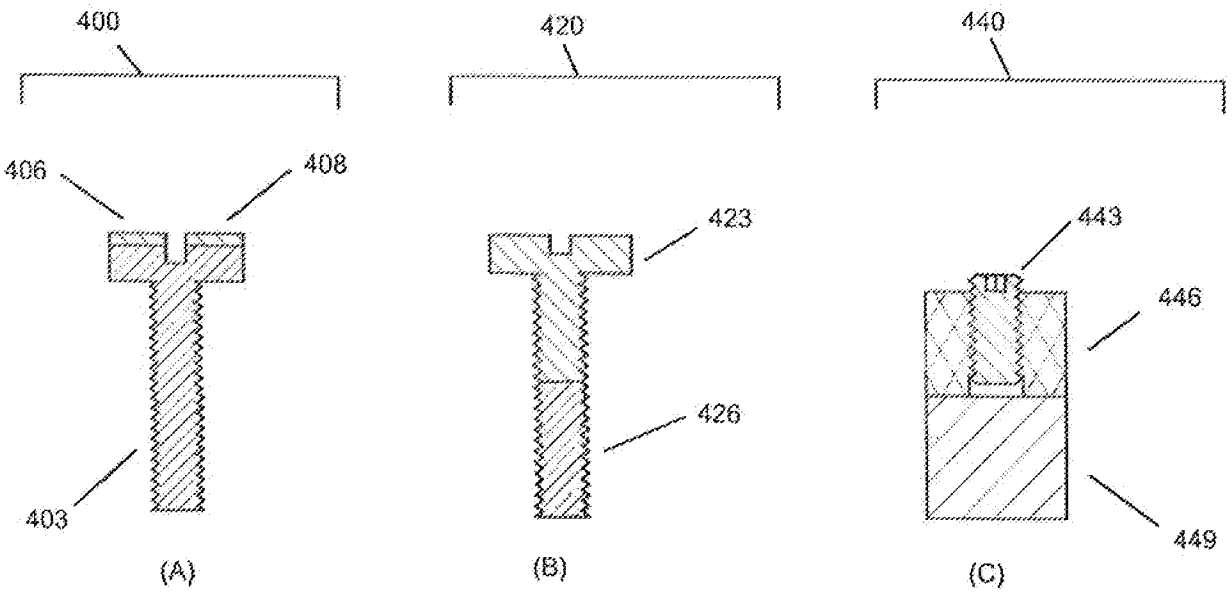
FIG. 8 is a sectioned drawing that illustrates alternative composite screw pole piece designs.

In the illustrated humbucking pickup 300 the screw pole pieces are formed from a single material. In other embodiments, however, one or more of the screw pole pieces may be a composite pole piece. FIG. 8, illustrates exemplary composite screw pole piece designs that may be used in humbucking and single coil embodiments of the invention. In the design 400 of FIG. 8(A) the composite screw pole piece is a capped pole piece in which the portions of the screw head on either side of the slot are capped with different pieces 406,408 of the same ferromagnetic material. The screw body 403 is formed from a machinable ferromagnetic material with ferromagnetic properties that differ from the ferromagnetic properties of the pole cap pieces 406,408.

In the design 420, the composite screw pole piece is formed from two machinable ferromagnetic material pieces 426, 423 that are bonded together. Suitable machinable ferromagnetic materials include but are not limited to low and ultralow carbon steels, machinable ferromagnetic stainless steel alloys, alloys of FeCoCr, CuNiFe, and a wide range of bonded hard and soft magnetic materials. Bonded materials are particularly useful in this design due to their wide range of material properties and the ease with which they can be threaded and bonded.

In the design 440, a ferromagnetic Allen screw 443 is threaded into a composite body with components 446,449 that are formed from ferromagnetic materials with different ferromagnetic properties. The screw may be a conventional hardened steel fastener or it may be formed from a different machinable ferromagnetic material. The upper body component 446 may be formed from a machinable carbon steel or an alternative machinable ferromagnetic material. The lower body component 449 is not threaded and may be formed from a wide range of soft and hard ferromagnetic materials, that include soft and hard ferrites and the alnico alloys. Threaded components may be easily cast or machined from bonded soft and hard ferromagnetic materials and any of the pole piece components 443, 446 and 449 may be fabricated from these materials.

Figure 9:
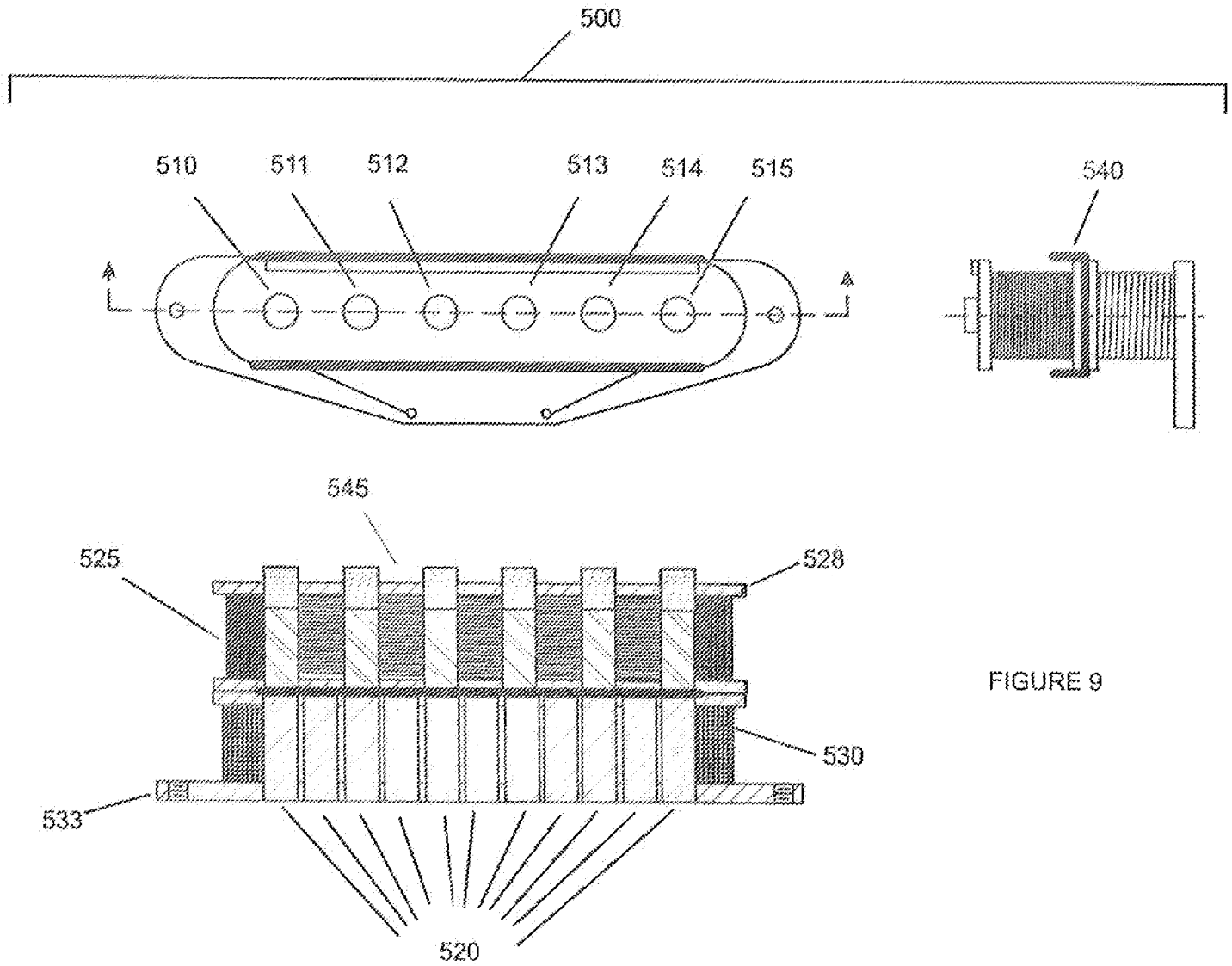
FIG. 9 is a sectioned orthographic projection drawing of a noiseless single coil pickup with composite pole pieces.

FIG. 9 is a sectioned orthographic drawing that illustrates a noise-cancelling single coil pickup 500 embodying features of the invention. In the pickup 500, a set of composite string-sensing pole pieces 510-515 are mounted in an upper bobbin 528 and surrounded by a string-sensing wire coil 525 that is wound on the bobbin 528. A set of passive pole pieces 520 is mounted in a lower bobbin 533 and surrounded by a noise-cancelling coil 530. The passive pole piece set 520 is magnetically shielded from the string-sensing pole piece set 510-515 by a metal plate 540. As illustrated in FIG. 9, the string-sensing pole pieces 510-515 have a common composite design. This design is similar to the pole piece design that is illustrated in FIG. 2 with a magnetized Alnico 5 upper component and a lower component that is formed from a low loss, medium permeability ferrite that may be, for example, Fair-Rite Material 77. The two component pieces of each pole piece are bonded together with cyanoacrylate cement or an epoxy.

Noise cancellation is achieved by connecting the coils 525 and 530 so that the noise signal from the noise cancelling coil 530 is opposite in phase to the noise signal generated by the string sensing coil 525.

In further embodiments, the invention provides methods for changing the tone of an existing pickup by converting one or more monolithic pole pieces to composite pole pieces. Depending on the design of the pickup and monolithic pole pieces, the conversion may be accomplished by replacing a monolithic pole piece with a composite pole piece of approximately the same outside dimensions or by simply mounting a pole cap on the string-sensing surface of a monolithic pole piece. In a conventional humbucking pickup the slug pole pieces are press fit into one bobbin and the screw pole pieces are typically threaded into the other bobbin. According to the invention, one or more of the slug pole pieces may be replaced by composite pole pieces and/or one or more of the screw pole pieces may be replaced by composite screw pole pieces. Possible designs for the slug pole pieces are illustrated in FIG. 2 and FIG. 3 but are not limited to these examples. Similarly, direct replacement composite screw pole pieces may have a design as shown in FIG. 8(A) or FIG. 8(B) but the design of the replacement screws is not limited to these examples.

In one example of the pole piece replacement method, the low carbon steel slugs of a 9000 Ohm, PAF-style humbucking bridge pickup manufactured by Lindy Fralin Pickups of Richmond, Va. were replaced by composite pole pieces that each comprised a 0.5" long cylinder of low loss, medium permeability ferrite material (Magnetic Arts of Escondido, CA part number FRD18750x6) and a 0.060" thick cylinder of low carbon steel. The components of each pole piece were joined with cyanoacrylate cement. The original pole pieces were pushed out of the bobbins and the replacements inserted so the string-sensing surfaces of each replacement pole piece was a surface of the low carbon steel component.

If the pole pieces of a pickup are the primary supporting structures for a coil, removing one or more of them can destroy the pickup. Pickups with coil-supporting pole pieces include, but are not limited to, the pickups in the Custom Shop Texas Special, 57/62 and '69 Stratocaster pickup sets manufactured by Fender Musical Instrument Company of Scottsdale, Ariz. In an alternative embodiment, the invention provides a method that may be used to alter the tone of any pickup with ferromagnetic pole pieces, including those with coil supporting pole pieces. This method comprises the step of attaching a pole cap to the string-sensing surface of the original pole piece. In an exemplary realization of this method, the harmonic content and the low-frequency response of the neck pickup in a set of Custom Shop Texas Special pickups was modified by attaching pole caps to the low E, A and high E pole pieces. The low E and A pole caps were 0.187" diameter by 0.030" discs of a low loss, medium permeability ferrite material with ferromagnetic material properties similar to those of Fair-Rite Material 77 and the high E pole piece was a 0.017"×0.040" thick disc of partially magnetized Alnico 2.

It will be obvious to those skilled in the art that the representative embodiments described in this application are but a small fraction of the large number of different embodiments that can be obtained by incorporating composite pole pieces in conventional magnetic pickup designs. For example, composite pole pieces may be advantageously incorporated in P-90 pickups, mini-humbucking pickups including NY, Johnny Smith, and Firebird style mini-humbuckers, split rail single coil pickups, narrow-field humbucker pickups, lipstick tube pickups, active pickups, and pickups with one or more blade-type pole pieces. It will additionally be obvious that composite pole pieces may be the basis for new and novel pickup designs with tonal characteristics that cannot be obtained using conventional single-material pole pieces.

The invention claimed is:

1. A magnetic pickup for generating an electronic signal in response to string vibrations in a musical instrument, the pickup comprising:

two self-contained string-sensing pole pieces, at least one of the two pole pieces comprising first and second discrete ferromagnetic components in fixed relative positions, the first ferromagnetic component being formed from a material in a group consisting of cast alnico alloys, sintered alnico alloys, bonded hard ferromagnetic materials, flexible hard ferromagnetic materials and machinable hard ferromagnetic materials, and the second ferromagnetic component having properties that are different from ferromagnetic material properties of the first ferromagnetic component;

a wire coil that at least partially surrounds the pole pieces; and a mount that holds the pole pieces in a fixed and nonadjustable position with respect to the wire coil and secures the pole pieces to the musical instrument.

2. The magnetic pickup of claim 1 wherein the first component is not fully magnetized.

3. The magnetic pickup of claim 1 wherein adjacent surfaces of the first and second ferromagnetic components of the at least one of the two pole pieces are substantially parallel to a plane that is tangent to a string sensing surface of the at least one of the two pole pieces at an approximate center point of the string sensing surface.

4. The magnetic pickup of claim 1 wherein the and second ferromagnetic components of the at least one of the two pole pieces are joined with an adhesive.

5. The magnetic pickup of claim 4 wherein the adhesive is electrically conductive.

6. The magnetic pickup of claim 4 wherein the adhesive is magnetically permeable.

7. The magnetic pickup of claim 1 wherein the mount comprises a body that holds at least one component of the at least one of the two pole pieces and a removable carrier that holds one or more different components of the at least one pole piece.

8. A magnetic pickup for generating an electronic signal in response to string vibrations in a musical instrument, the pickup comprising:

a first set of two or more pole pieces with string-sensing surfaces, the first set comprising a self-contained composite pole piece with integrated ferromagnetic properties that differ from the integrated properties of another pole piece in the set, the composite pole piece comprising first and second discrete ferromagnetic components such that the properties of the first component differ from the ferromagnetic properties of the second component;

a magnetic device that generates a magnetic flux in the first set of pole pieces; and at least one string-sensing wire coil that links at least a portion of the magnetic flux in the first set of pole pieces.

9. The magnetic pickup of claim 8 wherein the magnetic device comprises the first set of pole pieces.

10. The magnetic musical instrument pickup of claim 9 wherein the string sensing surface of the composite pole piece is a surface of a magnetized component.

11. The magnetic musical instrument pickup of claim 8 wherein the first set of pole pieces comprises two composite pole pieces.

12. The magnetic musical instrument pickup of claim 11 wherein an integrated ferromagnetic property in a first one of the two composite pole pieces is different than the integrated property in a second one of the two composite pole pieces.

13. The magnetic musical instrument of claim 12 wherein a component in the first one of the two composite pole pieces is formed from a material that is absent in a second one of the two composite pole pieces.

14. The magnetic musical instrument of claim 12 wherein the two composite pole pieces have the same component materials and the volume ratios of the components in the first one of the two composite pole pieces is different than that volume ratios of the components in the second one of the two composite pole pieces.

15. The magnetic musical instrument pickup of claim 8 comprising a second coil that is connected to the string-sensing coil in a noise-cancelling configuration.

16. The magnetic musical instrument pickup of claim 15 further comprising a second set of string-sensing pole pieces that is at least partially surrounded by the second coil.

17. The magnetic musical instrument pickup of claim 15 further comprising a set of passive pole pieces that is at least partially surrounded by the second coil.

18. The magnetic musical instrument pickup of claim 8 further comprising a mechanical assembly that holds the first set of pole pieces, the string sensing coil and the magnetic device in a stable configuration.

19. The magnetic pickup of claim 18 wherein the mechanical assembly comprises a body that holds at least one component of the composite pole piece and a removable carrier that holds one or more different components of the composite pole piece.

20. A method of retrofitting a musical instrument pickup to change tone, the pickup comprising two monolithic pole pieces with string-sensing surfaces, a magnetic source that produces a magnetic flux in the two monolithic pole pieces, and a wire coil that at least partially surrounds the two monolithic pole pieces, the method comprising the step of:

reconfiguring at least one of the two monolithic pole pieces as a self-contained composite pole piece comprising two discrete ferromagnetic components with different, ferromagnetic properties.

21. The method of claim 20 wherein the at least one of the two monolithic pole pieces is reconfigured as a self-contained composite pole piece by mounting a pole cap on a string-sensing surface of the monolithic pole piece.

22. The method of claim 20 wherein the at least one of the two monolithic pole pieces is reconfigured by removing the monolithic pole piece from the pickup and replacing it with the self-contained composite pole piece.

23. The magnetic pickup of claim 20 wherein the two ferromagnetic components of the composite pole piece have different chemical compositions.

24. The magnetic pickup of claim 1 wherein the first ferromagnetic component is formed from a bonded hard ferromagnetic material.

25. The magnetic pickup of claim 1 wherein the first ferromagnetic component is formed from a machinable hard ferromagnetic material.

26. The magnetic pickup of claim 1 wherein the first ferromagnetic component is formed from an Alnico alloy.

27. The magnetic pickup of claim 1 wherein the first and the second ferromagnetic components have different chemical compositions.

28. A magnetic pickup for generating an electronic signal based on string vibrations in a musical instrument, the pickup comprising:

a set of two or more string-sensing pole pieces, the set comprising a self-contained composite pole piece, the composite pole piece comprising two discrete hard ferromagnetic components with different ferromagnetic material properties;

a magnetic device that generates a magnetic flux in the set of pole pieces; and a string sensing wire coil that links at least a portion of the magnetic flux in the set of pole pieces.

29. The magnetic pickup of claim 28 wherein at least one of the two hard ferromagnetic components is not fully magnetized.

30. The magnetic pickup of claim 28 wherein the magnetic device comprises the self-contained composite pole piece.

31. The magnetic pickup of claim 28 wherein the two hard ferromagnetic components have different chemical compositions.

32. The magnetic pickup of claim 28 further comprising a soft ferromagnetic component.

33. The magnetic pickup of claim 28 further comprising a mount that holds the set of pole pieces and the wire coil in stable relative positions, the mount comprising a body that holds at least one component of the composite pole piece and a removable carrier that holds one or inure different components of the composite pole piece.

34. A magnetic pickup for generating an electronic signal based on string vibrations in a musical instrument, the pickup comprising:

a set of two or more string-sensing pole pieces, the set comprising a composite pole piece having at least two discrete soft ferromagnetic components with different ferromagnetic material properties that are mounted in fixed and nonadjustable relative positions;

a magnetic device that generates a magnetic flux in the set of pole pieces; and a string-sensing wire coil that links at least a portion of the magnetic flux in the set of pole pieces.

35. The magnetic pickup of claim 34 wherein adjacent surfaces of the two soft ferromagnetic components of the composite pole piece are substantially perpendicular to a plane that is tangent to a string sensing surface of the composite pole piece at an approximate center point of the string sensing surface.

36. The magnetic pickup of claim 34 wherein adjacent surfaces of the two soft ferromagnetic components of the composite pole piece are substantially parallel to a plane that is tangent to a string sensing surface of the composite pole piece at an approximate center point of the string sensing surface.

37. The magnetic pickup of claim 34 further comprising a hard ferromagnetic component.

38. The magnetic pickup of claim 34 wherein the two ferromagnetic components of the composite pole piece have different chemical compositions.

39. The magnetic pickup of claim 34 further comprising a mount that holds the set of pole pieces and the coil in stable relative positions, the mount comprising a body that holds at least one component of the composite pole piece and a removable carrier that holds one or more different components of the composite pole piece.

* * * * *